US010127898B1

(12) United States Patent
Baron, Jr.

(10) Patent No.: US 10,127,898 B1
(45) Date of Patent: Nov. 13, 2018

(54) HARMONICA CLEANING

(71) Applicant: Michael J Baron, Jr., Winston-Salem, NC (US)

(72) Inventor: Michael J Baron, Jr., Winston-Salem, NC (US)

( * ) Notice: Subject to any disclaimer, the term of this patent is extended or adjusted under 35 U.S.C. 154(b) by 0 days.

(21) Appl. No.: 15/926,060

(22) Filed: Mar. 20, 2018

(51) Int. Cl.
*G10G 7/00* (2006.01)
*G10D 7/12* (2006.01)

(52) U.S. Cl.
CPC ..... *G10G 7/00* (2013.01); *G10D 7/123* (2013.01)

(58) Field of Classification Search
CPC ..... G10G 7/00
See application file for complete search history.

(56) References Cited

U.S. PATENT DOCUMENTS 8,802,950 B2 * 8/2014 Bibollet ..... G10D 7/123 84/377

* cited by examiner

*Primary Examiner* — Kimberly Lockett
(74) *Attorney, Agent, or Firm* — Womble Bond Dickinson (US) LLP

(57) ABSTRACT

Accumulated saliva, other liquid and/or debris is removed from the interior of a harmonica by placing the harmonica in a carrier and twirling the carrier in an orbital path. The saliva, other liquid and/or debris is ejected from the holes or the harmonica by centrifugal force.

20 Claims, 3 Drawing Sheets

HARMONICA CLEANING

BACKGROUND

Horn players are able to drain accumulated saliva through the spit valve that manufacturers place at a low point on the instrument. Harmonica players are not so fortunate. There has been no suitable method for removing the saliva, any other liquid and/or debris that collects in the fragile interior of the harmonica—until now. The present invention relates to the cleaning of the interior of a harmonica by the removal of accumulated saliva, any other liquid, and/or debris therefrom.

When a harmonica is played, saliva, and possibly other liquids such as condensation from the player's breath, and even beverages and food particles, will accumulate in the interior of the instrument. This accumulation of liquid and debris is not only unsanitary and odorous, but also accelerates the corrosion and deformation of the harmonica's delicate reeds which, in turn, significantly shorten the playable life of the instrument, For more than a century, it has been the practice of harmonica players to attempt to periodically remove the saliva and/or other liquid and debris from the instrument by rapping it against their leg, arm or other suitable surface, whereby the inertia of the saliva, any other liquid, and debris will cause them to be ejected. However, players are left to guess how forceful the rapping should be, and how long the rapping should continue. And even if they see moisture appear, they have no way of knowing how successful the removal attempt has been.

The practice of subjecting the harmonica to the impact from such rapping is undesirable because it can cause one or more of the delicate reeds to deform, become stuck or go out of tune and immediately make the instrument unplayable, ruining the instrument for future use. Rapping presents a threat to the integrity and life of the reeds, and not rapping (not removing saliva, other liquid and debris) also presents a threat to the integrity and life of the reeds.

Lastly, after practicing or performing on stage with as many as three or four harmonicas, it is likely that a majority of players will forget or neglect to clear the saliva, other liquid and debris from their harmonicas. And each time no effort is made, the saliva, other liquid and debris dries and hardens inside the harmonica's comb and around the reeds, and contributes to the premature failure of the instrument. Virtually all harmonica players consider a failure as one sour note or one missing note, and the instrument becomes unplayable.

SUMMARY

The present invention generally provides a method and apparatus for removing accumulated saliva, other liquid and/or debris from the interior of a harmonica without subjecting the harmonica to any potentially harmful impacts. The invention contemplates placing the harmonica in a cavity of a carrier which is connected to a flexible member, such as a cord or cable, and then twirling the harmonica and carrier in an orbital path, whereby the saliva, other liquid and/or debris will be subjected to substantial centrifugal force and thereby ejected from the harmonica's comb through the holes of the harmonica.

DESCRIPTION

Figure 1:
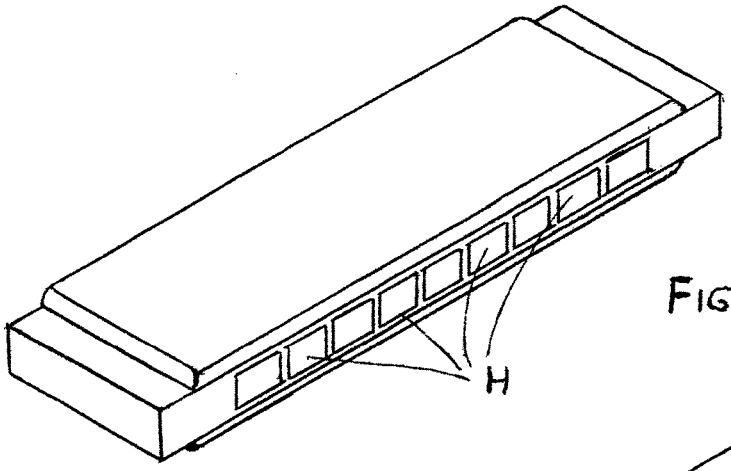
FIG. 1 is a schematic isometric view of a conventional harmonica.

FIG. 1 is a schematic view of a conventional harmonica as is well known in the art. When it is played, the user blows and draws air through a series of holes H on one side of the harmonica, and sound emanates from slots extending along the opposite side. The invention is applicable to all models and sizes of harmonicas, such as 10-hole diatonic, chromatic, etc.

Figure 2:
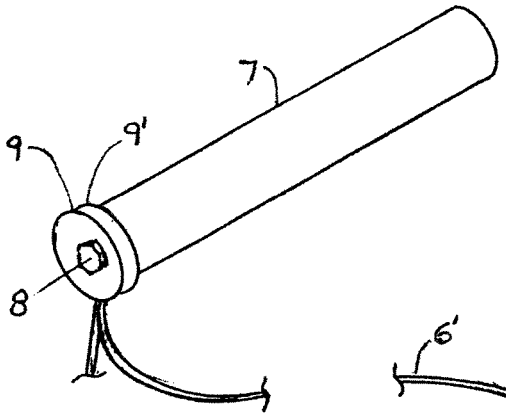
FIG. 2 is an isometric view of a first embodiment of the invention.
Figure 3:
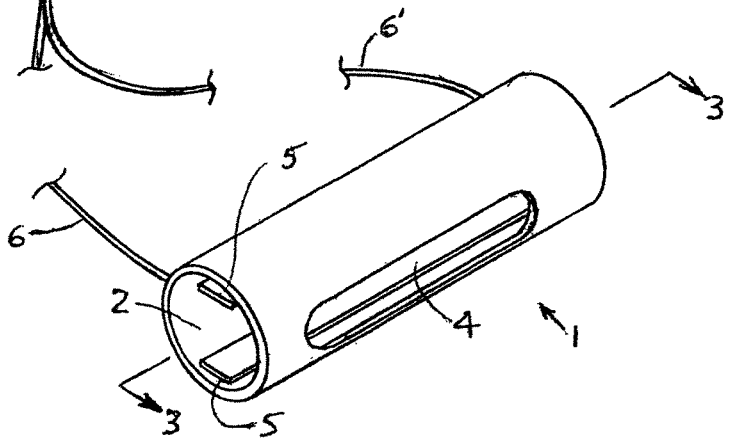
FIG. 3 is a longitudinal section of the carrier shown in FIG. 2 along the line 3-3, the harmonica being shown in dashed lines.
Figure 3:
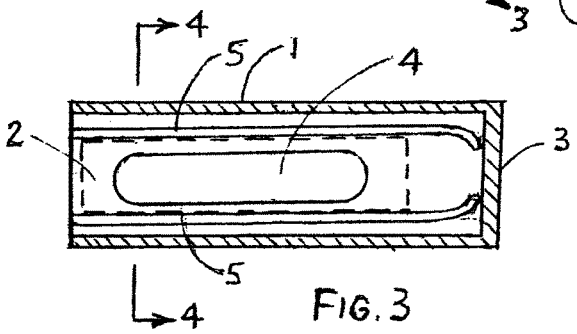
Figure 4:
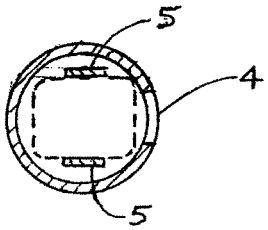
FIG. 4 is a cross section of the carrier along the line 4-4 of FIG. 3, the harmonica being shown in dashed lines.

FIGS. 2-4 illustrate apparatus according to a first embodiment of the invention. A tubular carrier 1 having an open end 2 and a closed end 3 has a bore or cavity into which a harmonica may be inserted. The position of the harmonica is indicated by dashed lines in FIGS. 3 and 4. The carrier 1 has a slot 4 along one side, the slot having a width and length such that the holes H of the harmonica will not be obstructed by the body of the carrier when the harmonica is oriented in the carrier with the holes H facing the slot 4, but the slot is not so large that the harmonica can pass through it. The harmonica is releasably held in the bore of the carrier 1 by leaf springs 5.

Flexible members 6, 6' of approximately equal length extend from securement points adjacent each end of the carrier 1 on the side opposite the slot 4. The flexible members 6, 6' are joined at their distal ends to form a loop. A cylindrical handle 7 has a screw 8 or other suitable fastener at one end, and two washers 9, 9' are carried by the screw 8. The loop at the ends oldie flexible members 6, 6' is located between the washers 9, 9' and around the screw 8 to attach the flexible members to the handle 7. Thus the handle 7 is located at a point approximately equidistant from the ends of the carrier.

FIGS. 5-8 illustrate apparatus according to a second embodiment of the invention. Carrier 10 has an elongated body with a slot 11 or cavity therethrough. At its upper end 12, the width and length of the slot 11 are sufficient to accommodate a harmonica. The width and length of the slot 11 may be just slightly larger than the respective width and length of a specific model of harmonica, so that it will fit snugly into the slot, while slightly protruding from upper end 12 of the slot to facilitate removal of the harmonica therefrom, or they may be sufficiently large to accommodate several models of harmonicas, e.g., models of 10 hole diatonic harmonicas having slightly different dimensions. In spite of their differing dimensions, these various models can be releasably retained in the slot 11 by a thumbscrew 19, which is threaded through the body of the carrier 10 and protrudes into the interior of slot 11, where it can engage the harmonica.

Figure 6:
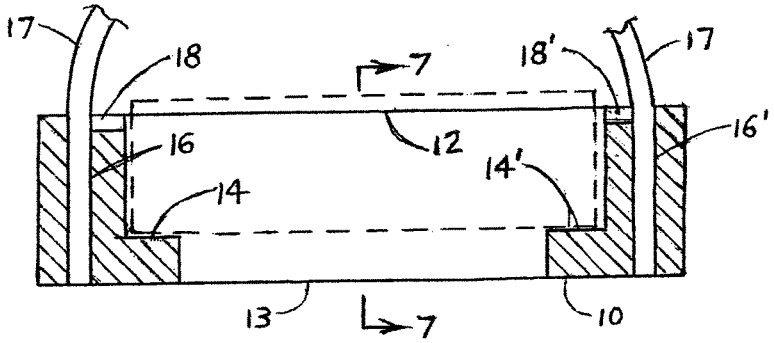
FIG. 6 is a longitudinal section of the carrier shown in FIG. 5 along the line 6-6, the harmonica being shown in dashed lines.
Figure 7:
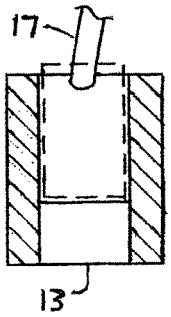
FIG. 7 is a cross section of the carrier along the line 7-7 of FIG. 6, the harmonica being shown in dashed lines.
Figure 8:
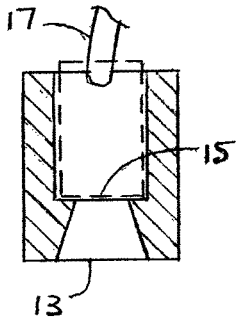
FIG. 8 is a cross section similar to FIG. 7, showing an alternative construction of the lower end of the slot, the harmonica being shown in dashed lines.

The position of the harmonica is indicated by dashed lines in FIGS. 6-8. The lower end 13 of the slot has a length that is less than the length of the harmonica, but sufficiently long that the holes H of the harmonica are not obstructed by the body of the carrier when the harmonica is oriented in the slot with the holes H facing the lower end 13 of the slot. Accordingly, there are two steps 14, 14' formed within the slot 11, on which the harmonica rests, as shown in FIG. 6. If desired, the lower end 13 of the slot may be tapered outwardly as shown in FIG. 8, with the inner end 15 having a width substantially equal to the size of the holes H in the harmonica.

Figure 5:
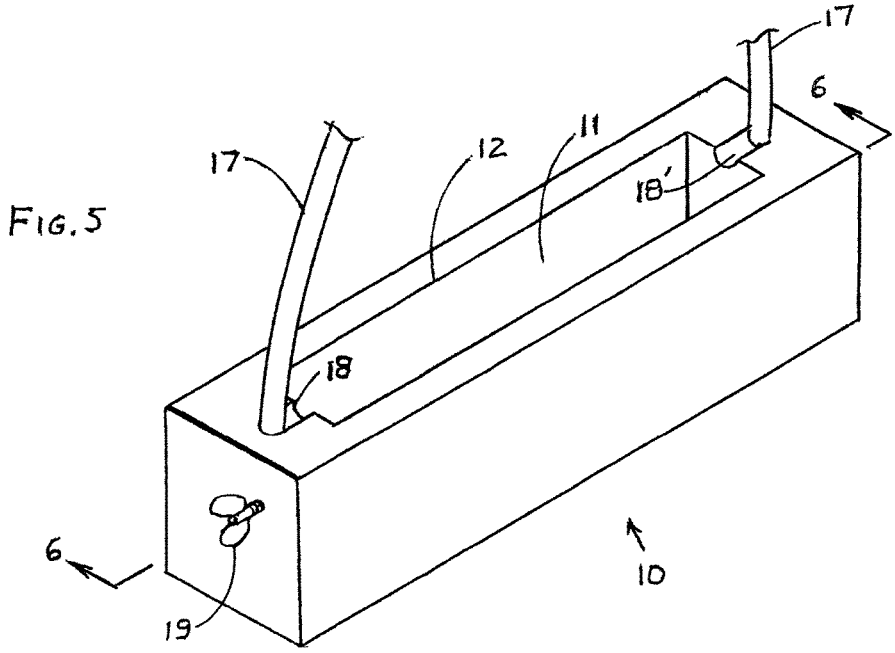
FIG. 5 is a isometric view of a second embodiment of the invention.

Holes 16, 16' are provided adjacent each end of the carrier 10, and the ends of a flexible member 17 are seemed in holes 16, 16' by glue or other suitable means, such as by a knot formed in each end of the flexible member 17, with the knots compressed in counterbores in the lower end of the body of the carrier 10. As indicated in FIG. 5, the flexible member 17 is a single piece which extends from hole 16 to hole 16' at the side of the carrier 10 where the upper end 12 of slot 11 is located, as shown in FIGS. 5 and 6, so that the flexible member 17 is at the opposite side of carrier 10 from the lower end 13 of slot 11 and from holes H in the harmonica, when the harmonica is inserted in the slot 11.

Alternatively, carrier 10 may be provided with two flexible members and a handle 7, as described above with regard to the embodiment of FIG. 1. Likewise, instead of the handle 7, carrier 1 may be provided with a single flexible member extending from adjacent one end of the carrier to the other, as described for the embodiment of FIG. 5.

The material of the flexible members 6, 6' or 17 may be wire, for example, but it is preferred to use a more flexible and collapsible material, such as parachute cord. The more flexible material allows the flexible member to be easily wrapped around the carrier or stuffed into the slot 11 when the apparatus is stored with the harmonica or placed in the player's pocket. To facilitate this, channels 18, 18' may extend from holes 16, 16' to slot 11.

The carrier may be made of any suitable material such as wood, plastic or metal. It may be fabricated from one or more parts, or may be injection molded in a single piece from a suitable plastic material.

Figure 9:
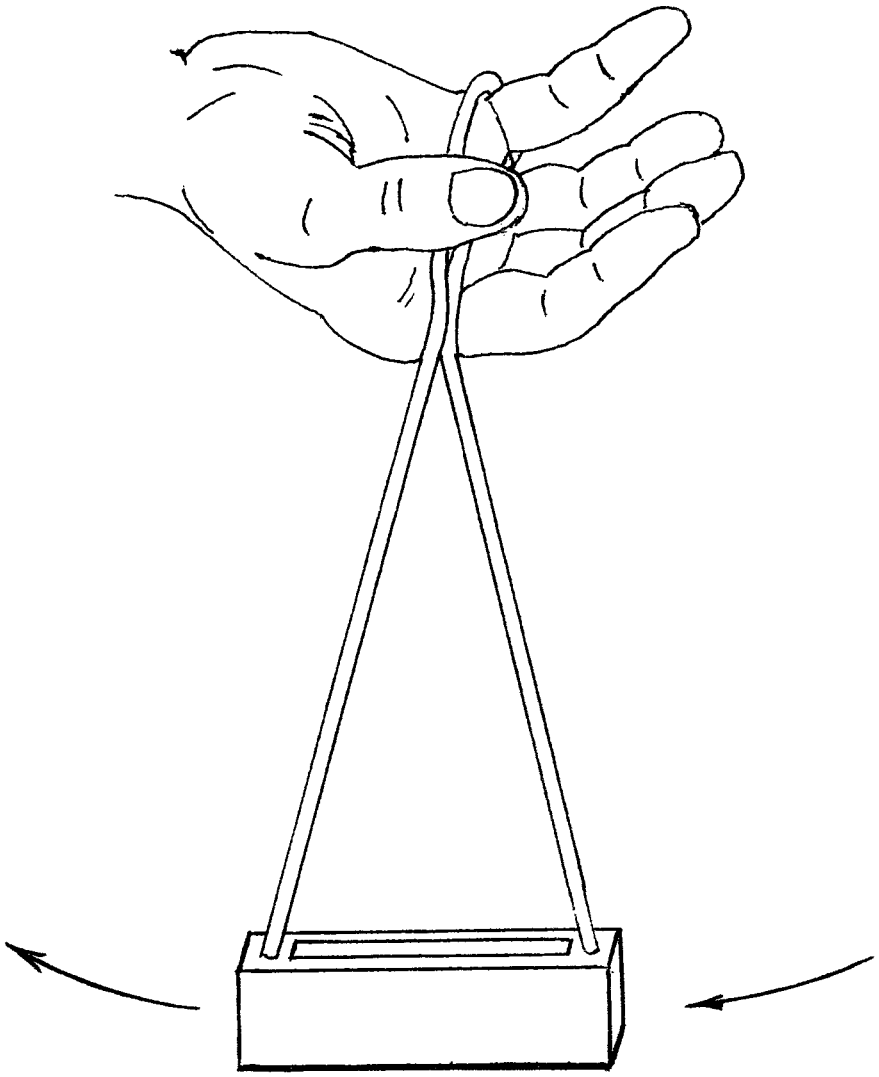
FIG. 9 illustrates the use of the invention.

In use of the embodiments described above, when it is desired to remove saliva, other accumulated liquid and/or debris from the interior of a harmonica, the harmonica is placed within the bore of carrier 1 (FIGS. 2-4) or the slot 11 of carrier 10 (FIGS. 5-8), the harmonica being oriented with its holes H facing the slot 4 of the carrier 1, or facing the lower end 13 of the slot in carrier 10, so that the holes H are not obstructed by the body of the carrier. The user then grasps the handle 7, if the carrier is so equipped, or grasps approximately the midpoint of the flexible member 17 if there is no handle, i.e., at a point approximately equidistant from the ends of the carrier. Preferably, if there is no handle, the flexible member is looped over the little finger to secure it when twirling, as shown in FIG. 9. Then, as shown in FIG. 9, the carrier and harmonica are twirled in an orbital path about the point where the handle or flexible member is grasped. Since the holes H in the harmonica face outwardly away from the center of the orbital path, the centrifugal force causes the saliva, other liquid and/or debris to be ejected from the interior of the harmonica through the holes H and the slot 4 of carrier 1 or through the holes H and the slot 13 of carrier 10.

When using the carrier 1 of FIG. 2, the carrier may desirably be twirled with the open end 2 facing forward. Twirling, the carrier in this direction forces air to flow into the bore of the carrier, and the increased air pressure inside the carrier causes air to escape through the harmonica and eject saliva, other liquid and/or debris through slot 4, thus aiding the centrifugal force in removing saliva, other liquid and/or debris from the interior of the harmonica.

When twirling the carrier 10 of FIG. 5, the centrifugal force tends to keep the harmonica pressed into the slot 11.

Although the invention has been described with reference to specific embodiments, this description is not intended to be construed in a limited sense, and it will be apparent to those skilled in the act that various modifications of the disclosed embodiments, as well as alternative embodiments of the invention, can be made. It is therefore contemplated that the appended claims will cover such modifications as may fall within the scope of the invention.

I claim:

1. Apparatus for removing saliva, other liquid and/or debris from the interior of a harmonica, the harmonica having a series of holes extending along one side thereof, comprising:

a carrier for the harmonica, the carrier having two opposed sides and two ends, and having a cavity or receiving the harmonica, there being an opening on one side of the carrier communicating with the cavity such that the holes of the harmonica are not obstructed by the carrier when the harmonica is located in the cavity with the holes facing the opening;

at least one flexible member extending from the carrier adjacent each end of the carrier, on the side of the carrier opposite the opening;

the at least one flexible member permitting a user to twirl the carrier in an orbital path about a point approximately equidistant from the ends of the carrier, whereby saliva, other liquid and/or debris will be ejected through the holes of the harmonica by centrifugal force.

2. The apparatus of claim 1, wherein the carrier comprises a tube with one closed end and one open end.

3. The apparatus of claim 1, including means for releasably retaining the harmonica within the cavity of the carrier.

4. The apparatus of claim 3, wherein said means comprises springs.

5. The apparatus of claim 3, wherein said means comprises a screw.

6. The apparatus of claim 1, wherein there are two flexible members, extending from points adjacent opposite ends of the carrier, the members being of approximately equal length, the distal ends of the flexible members being attached to a handle.

7. The apparatus or claim 1, wherein the at least one flexible member comprises a single flexible member secured at one of its ends to a point adjacent one end of the carrier, and at its other end to a point adjacent the other end of the carrier.

8. The apparatus of claim 1, wherein the at least one flexible member comprises wire or cord.

9. The apparatus of claim 8. wherein the at least one flexible member comprises parachute cord.

10. The apparatus of claim 1, wherein the carrier comprises an elongated body having a slot therethrough, one end of the slot having a length and width sufficient to receive the harmonica therein, the other end of the slot having a length which is less than the length of the harmonica but greater than the extent of the holes, whereby the holes are unobstructed by the carrier body When the harmonica is received therein.

11. The apparatus of claim 10, wherein there is a hole adjacent each end of the carrier into which the ends of the at least one flexible member are secured.

12. The apparatus of claim 10, wherein within the slot two shelves are formed upon which the harmonica rests.

13. The apparatus of claim 1, wherein the carrier comprises metal, wood or plastic.

14. The apparatus of claim 13, wherein the carrier comprises injection molded plastic.

15. A method of removing saliva, other accumulated liquid and/or debris from the interior of a harmonica, the harmonica having a series of holes along one side thereof, the method comprising:

placing the harmonica into a carrier having first and second ends, with the holes being unobstructed by the carrier;

twirling the carder in an orbital path, with the holes of the harmonica facing outwardly away from the center of the orbital path;

whereby the saliva, other liquid and/or debris is ejected from the holes of the harmonica by centrifugal force.

16. The method of claim 15, wherein the carrier includes a bore having an open end into which the harmonica is placed, and wherein the carrier is twirled in the orbital path in such a direction that air is forced into the open end of the bore.

17. The method of claim 15, wherein one or more flexible members are secured adjacent the first and second ends of the carrier, and including the step of grasping the one or more flexible members at a point approximately equidistant from the ends of the carrier for twirling of the carrier.

18. The method of claim 17, wherein the ono or more flexible members are grasped at said point by means of a handle.

19. The method of claim 17, wherein a single flexible member extends from a first point adjacent the first end of the carrier to a second point adjacent the second end of the carrier, and is grasped by hand at a point approximately equidistant from said first and second points for twirling of the carrier.

20. The method of claim 19, wherein the flexible member is looped around the little finger of the hand grasping the flexible member.

* * * * *